United States Patent [19]

Shaver et al.

[11] Patent Number: 4,477,263

[45] Date of Patent: Oct. 16, 1984

[54] APPARATUS AND METHOD FOR NEUTRALIZING STATIC ELECTRIC CHARGES IN SENSITIVE MANUFACTURING AREAS

[76] Inventors: John D. Shaver, 12 Sunrise Ct., Clover, S.C. 29710; Claude G. Adkins, P.O. Box 534, Fort Mill, S.C. 29715; Walter Spengler, Strehlgasse 5, 4105 Biel-Benken, Switzerland

[21] Appl. No.: 392,531

[22] Filed: Jun. 28, 1982

[51] Int. Cl.[3] ..... B03C 3/14; B03C 3/41

[52] U.S. Cl. ..... 55/6; 55/105; 55/126; 55/146; 55/385 A; 55/DIG. 29; 361/231; 361/235

[58] Field of Search ..... 55/4, 6, 105, 106, 126, 55/138, 146, 152, 270, 279, 385 A, 483, 484, DIG. 29; 422/22, 121; 361/231, 235; 128/419 N

[56] References Cited

U.S. PATENT DOCUMENTS

| | | | |
|---|---|---|---|
| 940,431 | 11/1909 | Chapman | 55/146 |
| 1,925,243 | 9/1933 | Golden | 55/146 |
| 2,060,842 | 11/1936 | Yaglov | 55/385 A |
| 2,610,699 | 9/1952 | Penney et al. | 55/105 |
| 2,983,847 | 5/1961 | Spengler | 55/152 |
| 3,308,343 | 3/1967 | Smith et al. . | |
| 3,311,108 | 3/1967 | Cristofv et al. . | |
| 3,387,181 | 6/1968 | Michener et al. . | |
| 3,504,227 | 3/1970 | Wooton et al. . | |
| 3,624,448 | 11/1971 | Saurenman et al. | 55/101 |
| 3,654,534 | 4/1972 | Fischer . | |
| 3,678,337 | 7/1972 | Grauvogel | 361/231 |
| 3,702,526 | 11/1972 | Eichmeier | 55/146 |
| 3,711,743 | 1/1973 | Bolasny | 55/385 A |
| 3,818,269 | 6/1974 | Stark . | |
| 3,840,020 | 10/1974 | Smith . | |
| 3,942,072 | 3/1976 | Best et al. . | |
| 3,986,850 | 10/1976 | Wilcox | 55/385 A |
| 4,037,268 | 7/1977 | Gallagher . | |
| 4,064,548 | 12/1977 | Best et al. . | |
| 4,104,696 | 8/1978 | Cochran, Jr. . | |
| 4,109,290 | 8/1978 | Gallagher . | |
| 4,162,144 | 7/1979 | Cheney | 55/2 |
| 4,185,316 | 1/1980 | Fleck | 361/231 |
| 4,227,894 | 10/1980 | Proynoff . | |
| 4,253,852 | 3/1981 | Adams | 55/126 |
| 4,282,830 | 8/1981 | Saurenman | 119/21 |
| 4,319,302 | 3/1982 | Moulden | 361/231 |
| 4,398,667 | 6/1983 | Saurenman | 361/231 |

FOREIGN PATENT DOCUMENTS

| | | | |
|---|---|---|---|
| 2622749 | 12/1977 | Fed. Rep. of Germany | 361/231 |
| 420360 | 11/1934 | United Kingdom | 361/231 |
| 436467 | 10/1935 | United Kingdom | 361/231 |

*Primary Examiner*—David Lacey

*Attorney, Agent, or Firm*—Bell, Seltzer, Park & Gibson

[57] ABSTRACT

An apparatus and method for neutralizing static electric charges are disclosed, which include a cooperating pair of laterally spaced apart electrodes disposed so as to be in a flow path of a moving airstream. A relatively high positive DC voltage is applied to one electrode, and a relatively high negative DC voltage is applied to the other electrode. As a result, the electrodes generates free positive and negative ions, which are carried away by the airstream and delivered directly to the manufacturing area, where they are attracted to opposite static charges. Thus the ions act to neutralize static charges of either polarity, and the excess ions will eventually be attracted to each other or to ground, leaving no static in the area. In a preferred embodiment, the electrodes are mounted immediately downstream of a HEPA filter bank which removes essentially all particulate matter and dust before the ions are generated in the airstream.

16 Claims, 9 Drawing Figures

APPARATUS AND METHOD FOR NEUTRALIZING STATIC ELECTRIC CHARGES IN SENSITIVE MANUFACTURING AREAS

The present invention relates to the neutralization or elimination of static electricity in critical or sensitive manufacturing areas, such as clean rooms used for the production of semiconductors.

The manufacture of integrated circuit boards typically includes the steps of forming minute circuits on a silicon wafer, cutting the resulting wafers into chips of about ⅛ inch square, and then interconnecting a number of the chips on a circuit board to form the desired circuit. These manufacturing operations are usually conducted in a "clean" enclosure, such as a clean room or clean work station, and which includes high efficiency particulate air filters for removing substantially all particulate matter and dust from the air circulating therethrough, to thereby minimize the possibility of contamination of the workpieces.

While existing clean rooms and work stations are able to minimize contamination from particulate matter in critical or sensitive manufacturing areas, a continuing and persistent problem relates to the fact that static electricity tends to build up on the workpieces and other objects in the manufacturing area by reason of the workpieces being subjected to friction, pressure, or temperature change. Also, static electricity is often brought into the area with entering persons or raw materials. This static electricity is a principal factor in semiconductor contamination and degradation. More particularly, contamination can result from the static electricity attracting a dust particle to the workpiece, and degradation can result from the rapid change in potential due to current flow when the workpiece comes into contact with a grounded or oppositely charged object.

In an attempt to alleviate static electricity in sensitive manufacturing areas such as the manufacture of integrated circuit boards as described above, it has been proposed to ground all persons and objects in the manufacturing area. However, this is a cumbersome procedure and it cannot be totally effective since many of the materials in the room are nonconductive and thus will not transfer a static charge to ground.

It has also been proposed to ionize the air at clean work stations or benches, by providing a grid immediately downstream of the filter which is subjected to a relatively low AC voltage, such as 4,000 to 5,000 volts, and which alternately produces positive and negative ions. The resulting ions act to neutralize static charges on objects which are contacted by the ions. However, the AC current is not able to throw off ions more than a very limited distance, since the alternating nature of the current tends to pull back the ions upon each cycle reversal. Thus while this ionization has achieved some success in very confined areas such as clean work stations or benches where the workpieces are positioned a very short distance from the grid, it has not proven satisfactory for a large clean room or manufacturing area.

The prior U.S. patents to Best et al, U.S. Pat. Nos. 3,942,072 and 4,064,548 describe a system for reducing a positive or negative field in a manufacturing area, and which includes two serially spaced apart thin wire grids positioned in an air conditioning duct, and with one grid connected to a positive high voltage source and the other connected to a negative high voltage source, to produce both positive and negative ions. However, this system has not been found to be satisfactory in actual practice since the downstream duct apparently tends to ground the ions and thus insufficient numbers of ions are able to be discharged from the duct. Also, the thin wire grid is susceptible to breakage.

It is accordingly an object of the present invention to provide an apparatus and method which are able to effectively eliminate static electricity in critical or sensitive manufacturing areas, including large clean rooms and the like.

It is a more particular object of the present invention to provide an apparatus and method for generating large numbers of both positive and negative free ions within a relatively large manufacturing area, and such that the ions are able to rapidly eliminate static electricity on objects in the area, or objects brought into the area.

These and other objects and advantages of the present invention are achieved in the embodiments illustrated herein by the provision of a pair of electrodes which are operatively mounted so as to be spaced apart from each other in a direction extending transversely to the direction of air flow. Current generating means are also provided for supplying a relatively high positive DC voltage to one of the electrodes, and a relatively high negative DC voltage to the other of the electrodes. Thus the two electrodes act to concurrently generate positive and negative ions which are carried by the airstream directly into the manufacturing area.

The electrodes preferably include a plurality of needle like projections, which facilitate the formation and emission of ions into the airstream, and in one preferred embodiment, the electrodes are in the form of two elongate bars which are disposed parallel to each other, with the needle like projections directed toward each other. In another embodiment, the electrodes are in the form of paraboloids, with the needle like projections radiating therefrom.

Some of the objects having been stated, other objects will appear as the description proceeds, when taken in connection with the accompanying drawing in which.

Figure 1:
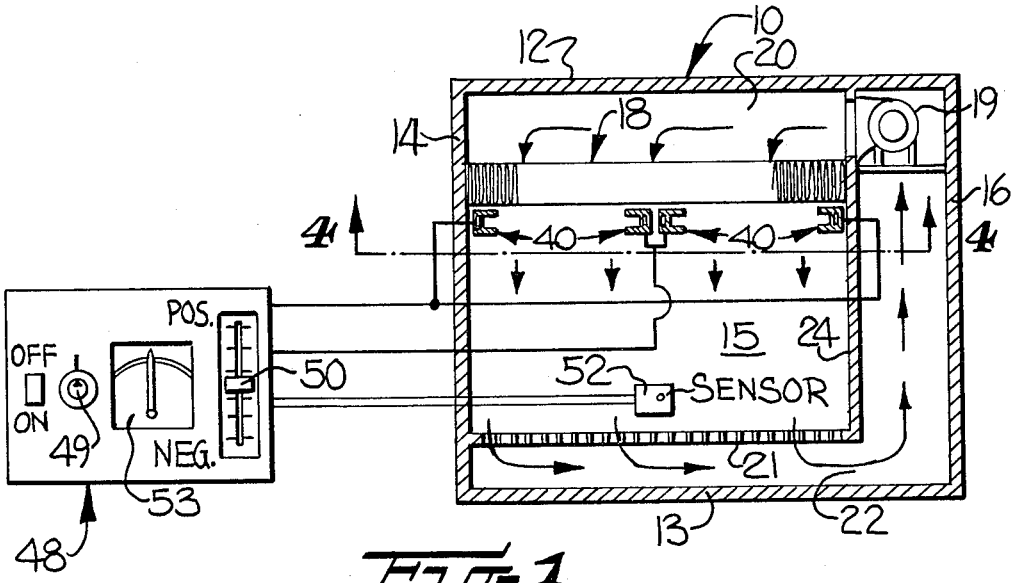
FIG. 1 is a generally schematic sectional side elevation view of a clean room which embodies the present invention.

Referring more particularly to the drawings, FIG. 1 schematically illustrates a clean room 10 embodying the features of the present invention. The room comprises an enclosure which includes a top wall 12, a bottom wall 13, and bounding side walls 14, 15, 16 (the fourth side wall not being shown). A horizontally disposed filter bank 18 is positioned within the enclosure parallel to and spaced from the top wall to define an open air supply plenum 20 therebetween. A raised floor 21 is mounted above the bottom wall 13 to define a return air plenum 22, with the floor 21 including a number of perforated panels for permitting air to pass therethrough. The return air plenum 22 communicates with a vertical duct defined between the outer side wall 16 and an interior wall 24, and which contains the air handling unit or blower 19 for recirculating the air into the air supply plenum 20. Thus in use, the air delivered to the air supply plenum 20 by the blower 19 passes downwardly through the filter bank 18 such that essentially all particulate contaminates are removed immediately before the air enters the working area of the room. The air then passes vertically downwardly through the room under essentially laminar flow conditions, and then passes through the floor 21 to the return air plenum 22.

In the embodiment specifically illustrated in FIGS. 4–7, the filter bank comprises a horizontally disposed supporting latticework frame composed of a plurality of interconnected U-shaped channels 28 having their open sides directed upwardly, with the channels being substantially filled with a suitable sealing fluid 29. A plurality of air filters 30 are positioned on the latticework with one of the filters covering each of the open areas defined by the latticework. Each filter 30 comprises a rectangular frame 32 and a filter pack 33 sealably disposed within the frame. Typically, the filter pack 33 comprises a sheet of high efficiency particulate air filtering media which is folded in accordion fashion in a manner well known in the art. Also, each filter 30 includes a downwardly depending metal skirt 34 positioned about the outer periphery of the frame, with the skirt being adapted to rest within the open channels 28 and so as to be sealably immersed in the fluid 29. If desired, a plurality of lighting fixtures 35 may be positioned intermediate certain of the filters and secured to the latticework. A further description of the above described filter bank and fluid sealing arrangement may be obtained by reference to U.S. Pat. No. 3,486,311 to Allan.

In accordance with the present invention, a plurality of pairs of electrodes 40 are mounted to the latticework and immediately downstream of the filter bank. Each pair includes an electrode **40*a* of one polarity, and an electrode 40*b*** of like construction and of the opposite polarity. The electrodes are spaced apart from each other in a direction extending generally parallel to the adjacent face of the filter bank and thus transversely to the direction of air flow through the bank.

Figure 2:
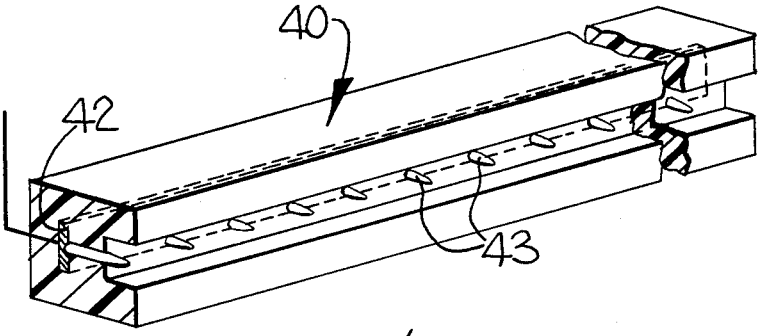
FIG. 2 is a perspective view of an ion generating electrode as utilized in the clean room shown in FIG. 1.
Figure 4:
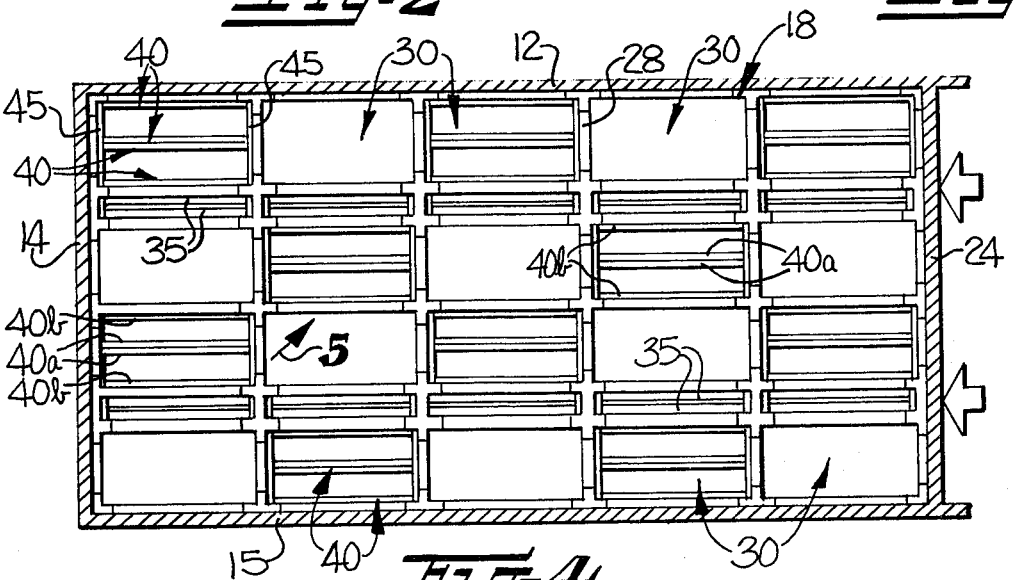
FIG. 4 is a bottom plan view, looking upwardly from the manufacturing area, of a filter bank and ion generating electrodes embodying the present invention.
Figure 5:
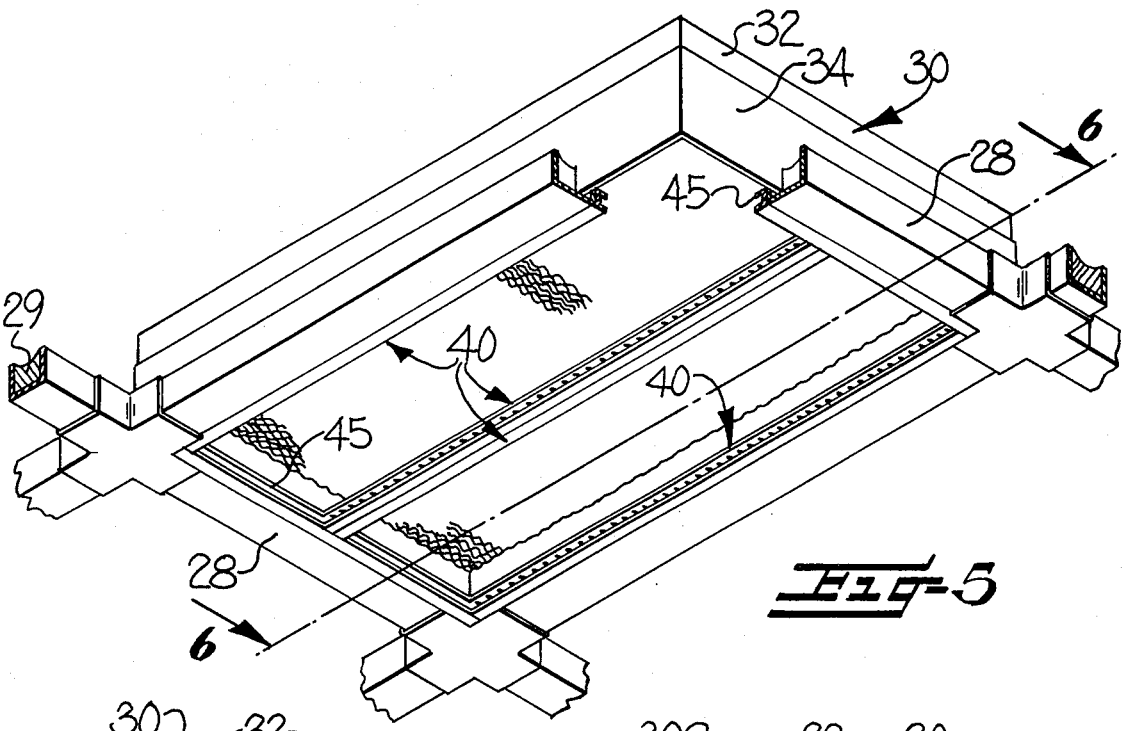
FIG. 5 is a fragmentary perspective view of the filter bank shown in FIG. 4.
Figure 6:
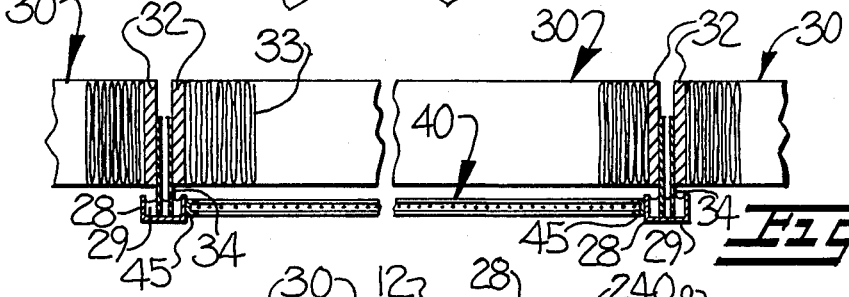
FIG. 6 is a horizontal sectional view taken substantially along the line 6—6 of FIG. 5.

In the embodiment of FIGS. 4–6, each electrode 40 comprises an elongate bar of C-shaped cross section as best seen in FIG. 2, and which is composed of epoxy or similar non-conductive material. A metal conductor 42 is embedded in the bar and extends along its length, and a line of spaced apart, metallic needle like projections 43 communicate with the conductor and extend outwardly from the bight of the bar when viewed in cross section.

In most clean rooms, it is unnecessary that all of the air be moved between operative electrodes, and under normal conditions, it is only necessary that about 25 to 50% of the air pass between cooperating pairs of electrodes. Thus in the illustrated embodiment, electrode bars **40*a*, 40*b* are mounted beneath only one half of the filters 30**, with the other filters being free of any underlying electrodes. Thus in the illustrated embodiment, only about 50% of the downwardly moving airstream moves between operative electrodes.

As best seen in FIGS. 4 and 5, two cooperating pairs of electrode bars **40*a*, 40*b* are mounted beneath one half of the filters in the bank. More particularly, the bars are secured to a peripheral frame member 45 which is secured to the inwardly facing edges of the channels 28, and so as to be substantially co-planar with the channels 28. The bars are grouped so that a single bar 40*b* is mounted along each side edge of the filter, and a pair of contiguous bars 40*a* of the same polarity are mounted to extend lengthwise along the medial portion of the filter, and with the bars thus being parallel to each other. Since filters of the illustrated type usually measure 24 by 48 inches, it will be appreciated that the electrodes of each cooperating pair 40*a*, 40*b* are spaced apart about 12 inches. Also, the bars are oriented so that the needle like projections 43 of each cooperating pair of bars face horizontally toward each other. Preferably, the frame member 45 is removably attached to the adjacent channels 28**, to permit its removal downwardly and thus permit access to the filter for periodic servicing or replacement.

Current generating means is also provided for supplying a relatively high DC voltage of one polarity to the electrode **40*a* of each pair, and a relatively high DC voltage of the opposite polarity to the electrode 40*b* of each pair. This current generating means includes a control unit 48 of conventional design, and which may be located either inside or outside of the enclosure 10. The control unit 48 is adapted to deliver a selected voltage, in the range between zero to about 35,000 volts to each electrode 40*a*, 40*b*. More particularly, the control unit includes a knob 49 for concurrently adjusting the total power to the two electrodes, and thereby permit adjustment of the overall rate of ion production. A control lever 50 is also provided which, upon upward movement, acts to increase the charge to both electrodes positively, and upon downward movement, to increase the charge to both electrodes negatively. When the lever arm is centered, the electrodes 40*a*, 40*b* are charged with equal voltages of opposite polarity. Thus the lever 50** permits a change in the relative percentage of positive and negative ions, so as to efficiently accommodate a manufacturing process which normally produces excessive positive or negative static charges.

An atmospheric static sensor 52 of known construction is positioned in the enclosure, and is operatively connected to a meter 53 on the control unit 48. Thus the output of the sensor 52 may be used to determine whether an increased charge in either the positive or negative direction is required.

The lateral spacing of the electrodes **40*a*, 40*b* of each pair is determined by a number of factors, including the static load in the clean room to be neutralized, the volume of air flow, and the applied voltage. However, it is preferable that the electrodes be positioned sufficiently close to each other so that the electrodes of each pair 40*a*, 40*b* interact and cooperate in drawing the ions from each other by reason of their opposite charges, and so that the ions may be readily removed and carried away by the airstream. Typically, the spacing should be about six to twelve inches to provide the desired cooperation. Also, the use of electrodes having the described needle like projection 43** is preferred, in that it appears that the projections tends to concentrate the electrical charge at their point free ends, which facilitates the emission of ions into the airstream. It is also preferred to position the electrodes of each pair with the needle like projections aligned and facing each other, since this orientation is believed to further facilitate the emission of ions.

In operation, it will be understood that the air handling unit 19 of the clean room 10 will serve to recirculate the air through the filter bank 18 and downwardly through the manufacturing or production area of the room, under essentially laminar flow conditions. The current generating means is then operated so that a relatively high positive DC voltage, such as between about 20,000 and 35,000 volts, is applied to one electrode of each pair. A negative DC voltage of corresponding magnitude is applied to the other electrode of each pair. Positive and negative ions are thereby generated at the respective electrodes, and the airstream passing between the electrodes acts to carry the ions away from the electrodes and directly into the underlying manufacturing area without contact with adjacent confining ductwork or the like. The absence of such ductwork is seen to minimize the loss of ions which would otherwise result from contact of the ions with such ductwork. Thus the manufacturing area is effectively "flooded" with substantially equal numbers of both positive and negative ions, which serve to rapidly eliminate static electricity on objects in the area, or objects brought into the area. More particularly, the ions are attracted to opposite static charges, and thus the ions act to neutralize static charges of either polarity. The excess ions will eventually be attracted to each other or to ground, leaving essentially no static charges in the manufacturing area. Where the sensor 52 and control unit 48 are employed, the magnitude and polarity of the static electricity in the enclosure may be monitored, and the controls 49 and 50 may be operated so as to selectively vary the voltage to each electrode and thereby permit control of the number of ions emitted from each electrode. By this arrangement, the system may be efficiently operated to eliminate static electricity under changing conditions in the manufacturing area, or where the particular manufacturing process tends to generate either positive or negative static charges.

Figure 3:
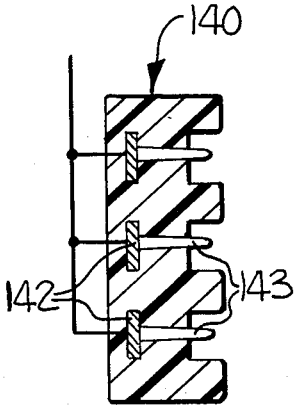
FIG. 3 is a sectional end view of an alternative embodiment of an ion generating electrode adapted for use with the present invention.

FIG. 3 illustrates another embodiment of an electrode bar 140 suitable for use with the present invention. The bar is generally similar to the bar 40, except that it includes three parallel conductors 142 and three rows of needle like projections 143 extending along its length. The additional projections provided by this construction are believed to increase the number of ions delivered into the airstream moving thereacross.

Figure 7:
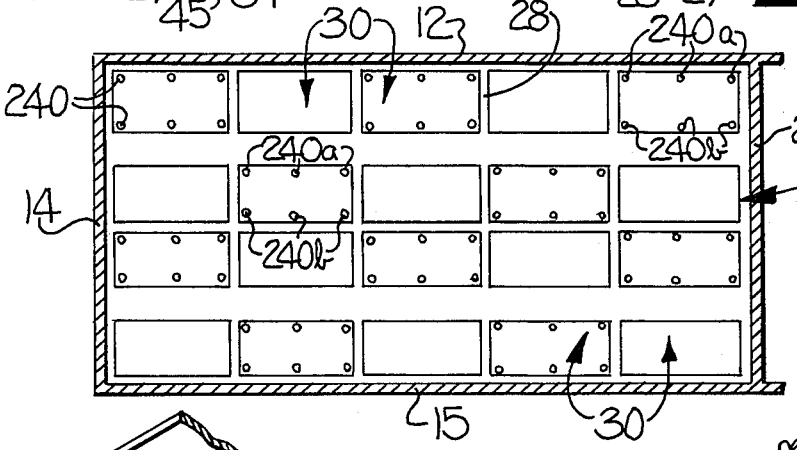
FIG. 7 is a bottom plan view of a similar filter bank, and illustrating a second embodiment of the ion generating electrodes.
Figure 8:
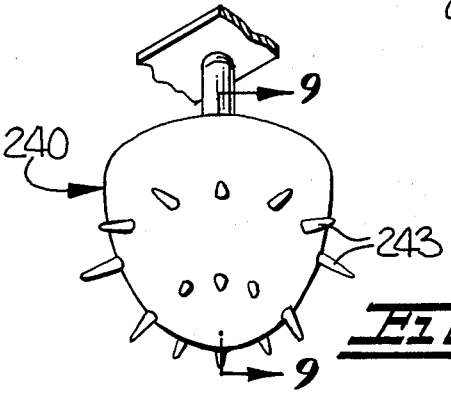
FIG. 8 is a perspective view of one of the electrodes shown in the embodiment of FIG. 7.
Figure 9:
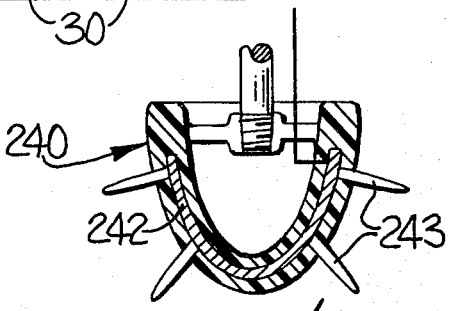
FIG. 9 is a sectional view of the electrode shown in FIG. 8.

FIGS. 7–9 illustrate a further embodiment of the invention, and wherein the electrodes 240 are of a three dimensional solid configuration. More particularly, the electrodes 240 are in the form of a paraboloid, and they include an internal conductor 242 which supports a plurality of radiating needle like projections 243. Cooperating pairs of these electrodes 240*a*, 240*b* are adapted to be mounted immediately downstream of a filter bank in the manner schematically illustrated in FIG. 7, with the electrodes 240*a* being of one polarity, and the electrodes 240*b* being of the opposite polarity.

In the drawings and specification, there has been set forth a preferred embodiment of the invention, and although specific terms are employed, they are used in a generic and descriptive sense only and not for purposes of limitation. For example, while the specific embodiment of the invention described herein relates to a "clean" manufacturing area, it will be appreciated that the invention may also be employed in any manufacturing, laboratory or production area where static electricity is a problem.

That which is claimed is:

1. In a clean enclosure sized so as to be adapted to enclose a manufacturing area, means for moving an airstream along a path of travel through said enclosure, the improvement therein comprising apparatus for concurrently generating both positive and negative ions in the airstream such that the ions are able to rapidly neutralize static electricity on objects in or brought into the area, and comprising at least one pair of electrodes operatively mounted within the path of travel of said airstream in said enclosure, with each of said at least one pair of electrodes being in the form of elongate bars which are disposed parallel to each other, and with the electrodes of each pair being spaced apart from each other a distance of between about six to twelve inches in a direction extending transversely to the direction of the path of travel and having an intervening airspace therebetween which is free of any electrically conductive components, and each of said electrodes including a plurality of needle-like electrically conductive projections which extend toward the other electrode of the pair, and means for supplying a positive direct current voltage to one of said electrodes of each pair, and a negative direct current voltage to the other of said electrodes of each pair, with the magnitude of the supplied voltages being sufficient to cause the electrodes to interact and cooperate in drawing ions from each other, whereby both positive and negative ions may be concurrently generated and carried through the enclosure by the moving airstream.

2. The enclosure as defined in claim 1 wherein said voltage supplying means includes means for selectively varying the voltage to each electrode of each pair so as to permit adjustment of the rate of ion generation at each electrode.

3. The enclosure as defined in claim 1 further comprising high efficiency particulate air filter means mounted along said path of travel, with each pair of electrodes being mounted immediately downstream of said filter means.

4. The enclosure as defined in claim 1 wherein the portion of said enclosure immediately downstream of said electrodes is characterized by the absence of closely confining ductwork within said enclosure for enclosing the airstream, to thereby minimize the loss of ions which would otherwise result from contact with such ductwork.

5. In a clean enclosure having provision for supplying virtually particle free air to sensitive manufacturing areas and the like, a filter bank comprising at least one high efficiency particulate air filter, and blower means for circulating air through said bank and into said enclosure, the improvement therein comprising means for concurrently generating both positive and negative ions in the airstream and such that the ions are able to rapidly neutralize static electricity on objects in or brought into the enclosure, said ion generating means including at least one cooperating pair of electrodes mounted immediately adjacent said filter bank with each cooperating pair of electrodes being spaced apart from each other a distance of between about six to twelve inches in a direction extending generally parallel to the adjacent face of said filter bank and having an intervening airspace therebetween which is free of any electrically conductive components, and each of said electrodes including a plurality of needle-like electrically conductive projections, and means for supplying a positive direct current voltage to one of the electrodes of each pair, and a negative direct current voltage to the other electrode of each pair, with the magnitude of the supplied voltages being sufficient to cause the electrodes to interact and cooperate in drawing ions from each other, whereby both positive and negative ions may be concurrently generated in the airstream moving into said enclosure.

6. In a clean enclosure as defined in claim 5 wherein each cooperating pair of electrodes is positioned immediately downstream of said filter bank, and said electrodes of each pair are in the form of elongate bars which are disposed parallel to each other, and wherein at least a substantial portion of the needle-like projections on each bar are directed toward the cooperating bar.

7. In a clean enclosure as defined in claim 6 wherein said electrodes are sized and of a sufficient number such that at least about 25% of the air passing through said bank passes between a cooperating pair of electrodes.

8. In a clean enclosure as defined in claim 7 further comprising static sensing means positioned in said enclosure for providing an indication of the magnitude and polarity of any static electric charges therein.

9. In a clean enclosure as defined in claim 8 further including first control means for concurrently increasing or decreasing the voltage to both electrodes, and second control means for selectively changing the voltage to both electrodes either positively or negatively.

10. In a clean room having provision for supplying virtually particle free air to sensitive manufacturing areas and the like, and including a room like enclosure, a filter bank disposed within said enclosure and including a supporting framework defining a plurality of open areas, a plurality of high efficiency particulate air filters mounted on said framework with one of the filters covering each of the open areas, and blower means for circulating air through said bank and to a manufacturing area disposed in the remainder of said enclosure, the improvement therein comprising means for concurrently generating both positive and negative ions in the airstream delivered to the manufacturing area and such that the ions are able to rapidly neutralize static electricity on objects in or brought into the manufacturing area, said ion generating means including a plurality of cooperating pairs of electrodes mounted to said supporting framework and immediately downstream of said filter bank, with each cooperating pair of electrodes being laterally spaced apart from each other in a direction extending generally parallel to the adjacent face of said filter bank and thus transversely to the direction of the moving airstream and having an intervening airspace therebetween which is free of any electrically conductive components, and each of said electrodes including a plurality of needle like electrically conductive projections which extend toward the cooperating electrode, and means for supplying a positive direct current voltage to one of the electrodes of each pair, and a negative direct current voltage to the other electrode of each pair, and with the lateral spacing of said electrodes of each pair and the voltages supplied to said electrodes being coordinated so that the electrodes of each pair interact and cooperate in drawing ions from each other, and such that both positive and negative ions may be concurrently generated in the airstream moving into the manufacturing area of said enclosure.

11. A method for delivering air to a sensitive manufacturing area, and for rapidly neutralizing static electricity on objects in or brought into the area, and comprising the steps of moving an airstream between a cooperating pair of electrodes, with the electrodes being in the form of elongate bars which are disposed parallel to each other and spaced apart from each other a distance of between about six to twelve inches in a direction extending transversely to the direction of the airstream and having an intervening airspace therebetween which is free of any electrically conductive components, with each of said electrodes including a plurality of needle-like electrically conductive projections which extend toward the other electrode of the pair, while supplying a positive direct current voltage to one of said electrodes and a negative direct current voltage to the other of said electrodes, with the magnitude of the supplied voltages being sufficient to cause the electrodes to interact and cooperate in drawing ions from each other, and so as to concurrently generate both positive and negative ions in the airstream, and while directing the airstream and entrained positive and negative ions directly to the manufacturing area and without the use of confining ductwork, to thereby minimize the loss of ions which would otherwise result from contact with such ductwork.

12. The method as defined in claim 11 wherein the supplied voltage to each electrode is at least about 20,000 volts.

13. A method for delivering virtually particle free air to a sensitive manufacturing area and for rapidly neutralizing static electricity on objects in or brought into the area, and comprising the steps of moving an airstream through high efficiency particulate air filtering means to remove substantially all particulate matter therefrom, passing at least a substantial portion of the filtered airstream between a pair of electrodes, with the electrodes being positioned immediately downstream of the filtering means and spaced apart from each other in a direction extending transversely to the direction of the airstream and having an intervening airspace therebetween which is free of any electrically conductive components, and with each of said electrodes including a plurality of needle-like electrically conductive projections, and supplying a positive direct current voltage to one electrode and supplying a negative direct current voltage to the other electrode, with the magnitude of the supplied voltages being sufficient to cause the electrodes to interact and cooperate in drawing ions from each other, and so as to concurrently generate both positive and negative ions in the airstream, and directing the filtered airstream and entrained positive and negative ions to the manufacturing area.

14. The method as defined in claim 13 wherein the spacing between the electrodes is between about six to twelve inches, and the voltage supplied to each of the electrodes is in the range between about 20,000 to 35,000 volts.

15. The method as defined in claim 14 comprising the further step of sensing the magnitude and polarity of any static electricity adjacent the manufacturing area and adjusting the voltage of the electrodes to effectively and rapidly neutralize such static electricity.

16. The method as defined in claim 15 wherein the step of directing the filtered airstream and ions to the manufacturing area includes moving the airstream under substantially laminar flow conditions and without the use of closely confining ductwork, to thereby minimize the loss of ions which would otherwise result from contact with such ductwork.

* * * * *